US010465341B2

(12) United States Patent
Steger

(10) Patent No.: US 10,465,341 B2
(45) Date of Patent: Nov. 5, 2019

(54) FABRIC BELT

(71) Applicant: Mühlen Sohn GmbH & Co. KG, Blaustein (DE)

(72) Inventor: Alexandra Steger, Weißenhorn (DE)

(73) Assignee: Mühlen Sohn GmbH & Co. KG, Blaustein (DE)

( * ) Notice: Subject to any disclaimer, the term of this patent is extended or adjusted under 35 U.S.C. 154(b) by 0 days.

(21) Appl. No.: 16/349,387

(22) PCT Filed: Nov. 14, 2016

(86) PCT No.: PCT/DE2016/100532

§ 371 (c)(1),
(2) Date: May 13, 2019

(87) PCT Pub. No.: WO2018/086642

PCT Pub. Date: May 17, 2018

(65) Prior Publication Data

US 2019/0264392 A1 Aug. 29, 2019

(51) Int. Cl.
*D21F 11/12* (2006.01)
*D21F 7/08* (2006.01)

(52) U.S. Cl.
CPC ..... *D21F 7/086* (2013.01); *D21F 11/12* (2013.01)

(58) Field of Classification Search
USPC ..... 162/289
See application file for complete search history.

(56) References Cited

FOREIGN PATENT DOCUMENTS

| | | | |
|---|---|---|---|
| WO | 9607788 | A1 | 3/1996 |
| WO | 02086231 | A1 | 10/2002 |
| WO | 2018086642 | A1 | 5/2018 |

OTHER PUBLICATIONS

Foreign communication from a related counterpart application—International Search Report and Written Opinion, PCT/DE2016/100532, dated Jun. 13, 2017, 10 pages.
Foreign communication from a related counterpart application—International Preliminary Report on Patentability, dated Oct. 4, 2018, 4 pages.

*Primary Examiner* — Mark Halpern
(74) *Attorney, Agent, or Firm* — Conley Rose, P.C.; Rodney B. Carroll

(57) ABSTRACT

The invention relates to a fabric belt for the production of a corrugated cardboard web in a corrugated cardboard machine having several warp layers. In at least one edge region of the fabric belt, a surface of its upper warp layer has at least first regions (21) which consist of first yarns, and second regions (22) which consist of second yarns. The first yarns contain 30% b.w. to 100% b.w. aromatic polyamides, 0% b.w. to 70% b.w. aliphatic and/or alicyclic polyamides and 0% b.w. to 5% b.w. other materials. The total of the polyamides and other materials thus gives 100% b.w. The second yarns contain 50% b.w. to 85% b.w. polyester and/or aliphatic polyamides and/or alicyclic polyamides, 15% b.w. to 50% b.w. cellulose and 0% b.w. to 5% b.w. other materials. The total of the polyesters, polyamides, cellulose and other materials gives 100% b.w.

15 Claims, 6 Drawing Sheets

FABRIC BELT

CROSS REFERENCE TO RELATED APPLICATIONS

This application is a filing under 35 U.S.C. 371 of International Application No. PCT/DE2016/100532 filed Nov. 14, 2016, entitled "Fabric Belt," which application is incorporated by reference herein in its entirety.

FIELD OF THE INVENTION

The present invention relates to a fabric belt for producing a corrugated cardboard web in a corrugated cardboard machine.

PRIOR ART

Corrugated cardboard machines have upper belts and lower belts which transport the corrugated cardboard through the corrugated cardboard machine. The upper warp layer of these fabric belts is in direct contact with the corrugated cardboard. It transports this through the corrugated cardboard machine with a certain amount of static friction and ensures a controlled adhesion of the corrugated cardboard. For this purpose, the fabric belt extracts the moisture of the glue from the corrugated cardboard and dispenses it again at a later point in time.

The upper belt transports the corrugated cardboard, among other things, via heating plates. Edge regions of the upper belt, which project beyond the width of the transported corrugated cardboard, can thereby come into contact with the heating plates. These can reach temperatures of up to 200° C. This results in thermal damage to the edge regions, which reduces the lifespan of the fabric belt. In addition, a strong mechanical abrasion of the fabric belt occurs in the edge regions.

A fabric belt is known from WO 96/07788 A1 whose upper warp layer has only warp threads in the edge region, said warp threads consisting of aromatic polyamide fibres to which stainless steel fibres are added if necessary. Such a fabric belt is capable of withstanding the high temperatures of the heating plates in its edge regions as well as the abrasion occurring there. However, the continuous polyamide fabric prevents the absorption of water into the fabric belt in the edge region. As a result, the edge regions of this belt cannot contribute to moisture management during the production of corrugated cardboard.

A fabric belt is described in the WO 02/086231 A1 which has a material mixture with a fibre content of more than 30% of an aromatic polyamide on its entire paper side. The rest of the material mixture consist of polyester fibres and/or other support fibres. This fabric belt has an increased wear resistance. However, it has no reinforcement of the particularly stressed edge regions.

It is therefore a problem of the present invention to provide a fabric belt for a corrugated cardboard machine which, on the one hand, is so temperature-resistant and abrasion-resistant in its edge regions that it can withstand contact with the heating plates and, on the other hand, whose edge regions can contribute to moisture management during the production of corrugated cardboard.

DISCLOSURE OF THE INVENTION

This problem is solved by a fabric belt for the production of a corrugated cardboard web in a corrugated cardboard machine, said fabric belt having several warp layers and having, in at least one edge region, a surface of its top warp layer which has at least first regions and second regions. The first regions consist of first yarns and the second regions consist of second yarns. The first yarns contain 30% b.w. to 100% b.w. aromatic polyamides, 0% b.w. to 70% b.w. aliphatic and/or alicyclic polyamides and 0% b.w. to 5% b.w. other materials. The total of the polyamides and other materials gives 100% b.w. The second yarns contain 50% b.w. to 85% b.w. polyester and/or aliphatic polyamides and/or alicyclic polyamides. Furthermore, they contain 15% b.w. to 50% b.w. cellulose. In addition, they may contain 0% b.w. to 5% b.w. other materials. The total of the polyesters, polyamides, cellulose and other materials gives 100% b.w. The cellulose is in particular selected from viscose, cotton, modal, lyocell and mixtures thereof. Viscose is preferred here since, due to its swelling behaviour, it has particularly good water absorption behaviour in length and thickness. The other materials can, for example, be metal fibres which give the at least one edge region anti-static properties. Carbon fibres can also be used for this purpose. It may also be provided that other materials are arranged in further regions in the at least one edge region. Third regions which only consist of metal fibres and/or carbon fibres can thus be provided, for example, to obtain the anti-static properties.

The invention is based on the recognition that a full-surface design of the surface of an edge region made from first yarns which are particularly thermally and mechanically resistant is not necessary to increase the thermal resistance of the edge region to such an extent that it can withstand contact with the heating plates of a corrugator system without significant damage. In fact, it is sufficient to implement the surface in the edge region to be made from the first yarns only in some regions. This makes it possible to provide second regions, in addition to the first regions, which have second yarns with a good water absorption capacity. This enables moisture management of the corrugated cardboard even in the edge region of the fabric belt.

The first regions preferably cover ⅙ to ⅚ of the surface of the at least one edge region. More preferably, they cover ⅓ to ⅔ of the surface of the at least one edge region. The second regions preferably cover ⅙ to ⅚ of the surface of the at least one edge region. More preferably, they cover ⅓ to ⅔ of the surface of the at least one edge region. Most preferably, they cover the rest of the surface such that there are no further regions besides the first regions and the second regions. This ensures that, on the one hand, a sufficient thermal stability of the edge regions is achieved such that they can withstand the thermal load due to contact with heating elements of a corrugator system and, on the other hand, a sufficiently large area of the surface is occupied by second yarns which are able to transport moisture from the belt surface into lower fabric layers.

The second regions are preferably arranged on the surface such that all second regions are connected to one another on the surface. This enables a particularly effective transfer of absorbed moisture. The first regions thereby form islands which are enclosed by the second regions.

The width of each edge region preferably ranges from 400 mm to 650 mm, more preferably ranges from 400 mm to 600 mm. This ensures that no regions of the fabric belt which are not designed as edge regions can come into contact with the heating plates of the corrugated cardboard machine. Conventional fabric belts, as known from WO 96/07788 A1, are often designed with edge regions which are only 200 mm wide since these should be designed to be as narrow as possible due to the lack of water absorption capacity of the edge regions. However, this may undesirably lead to regions of the fabric belt which are not designed to be thermally stable coming into contact with the heating elements. The improved water absorption capacity of the fabric belt according to the invention means that even significant portions of an edge region can easily be covered by corrugated cardboard without it leading to problems in terms of moisture management. Therefore, the design of the fabric belt according to the invention makes it possible to make the edge regions wide, such that it is not possible for a central region between the edge regions to be exposed even when narrow corrugated cardboard webs are used.

The fabric belt is preferably designed in such a way that it has two edge regions, between which a central region is located. There are only second yarns on the surface of the upper warp layer of the central region. The central region thus has a very good water absorption capacity. At the same time, the fabric belt is easy to produce, since yarns are used for the surface of its central region which are also used on the surface of the edge regions.

The central region has, in particular, a width in the range from 800 mm to 2,100 mm. As a result, the fabric belt can be used in all common corrugated cardboard machines.

The first yarns and the second yarns are preferably made from staple fibres. Staple fibre yarns have the advantage, in contrast to monofilaments and wires, that they enable moisture absorption between their fibre strands. As a result, even the first yarns, which consist exclusively of materials which are not capable of absorbing water, can still absorb a certain amount of water. The water absorption capacity of the second yarns is also improved by the embodiment as staple fibres. It should be noted here that only the cellulose portion of the second yarns allows water absorption in the fibre material. The polyesters and polyamides as synthetic yarn components, on the other hand, cannot absorb water themselves. However, in the embodiment as a staple fibre yarns, they can embed it between their fibre strands and then pass it to the cellulose.

The first yarns and the second yarns respectively have a preferred yarn count (effective yarn count) in the range from 1,000 dtex to 5,000 dtex, more preferably in the range from 2,000 dtex to 4,000 dtex. This can be achieved, for example, by twisting several single yarns with the preferred metric count (Nm) of 20/2 to 20/10, more preferably 20/4 to 20/8. A definition of the count denominations used can be taken from standard DIN 60910. Such fibre counts enable high abrasion resistance of the fabric belt in its edge region. In order to further increase abrasion resistance, it is preferably provided that the warp threads of the upper warp layer of the fabric belt consist of several first yarns or several second yarns with said yarn count.

The first yarns preferably contain at least 30% b.w. meta-aramid. This aromatic polyamide gives the yarns a particularly good resistance. Meta-aramid has a lower modulus of elasticity than the polyester contained in the second yarns and the cellulose contained in the second yarns and can thus be stretched more easily. Moreover, it has comparatively high abrasion resistance.

Furthermore, it is preferred that the first yarns contain at least 10% b.w. para-aramid. This aromatic polyamide also has high thermal resistance. In contrast to the meta-aramid, it cannot be stretched due to its high modulus of elasticity. By suitably selecting the ratio between meta-aramid and para-aramid, the stretchability of the first yarns can be set in such a way that they substantially correspond to the stretchability of the second yarns. This is important in order to give the edge region a uniform stretch behaviour, which ideally corresponds at the same time to the stretch behaviour of the central region. In addition, para-aramid differs from all other materials used in the upper warp layer of the edge region in that it is coloured. It gives the first regions a yellow colour, thus allowing a user to distinguish the edge regions from the central region.

The aliphatic and/or alicyclic polyamides of the first yarns are preferably selected from polyamide 6 and/or polyamide 66. These polyamides have poorer thermal resistance than aromatic polyamides. However, in combination with the proportions of aromatic polyamides according to the invention, this is still sufficient to give the fabric belt sufficient thermal stability in its edge regions. At the same time, these materials are significantly more cost-effective compared to aromatic polyamides, which allows the fabric belt to be produced economically.

The arrangement according to the invention of the first regions and of the second regions on the surface of the upper warp layer can be achieved, in particular, by the warp threads of the upper warp layer of the at least one edge region consisting of the first yarns and the second yarns.

The weft threads consist, in particular, of a polyester. However, they cannot absorb water in the polyester material. In order for them to still make a small contribution to moisture management, it is preferred that the weft threads are staple fibres, which still enable a certain amount of moisture absorption between their fibre strands.

In order to be optimally suitable for use in a corrugated cardboard machine, the fabric belt preferably has an upper warp layer, an inner warp layer, a lower warp layer, binding threads as well as two to four layers of weft threads. Binding threads are understood as being threads which connect all layers of weft threads to one another.

The binding threads consist, in particular, of the second yarns. They thus enable moisture transport from the upper warp layer to the lower warp layer. A moisture distribution which is as even as possible over the entire belt thickness accelerates the drying of the belt during its further circulation in the corrugated cardboard machine.

The inner warp layer, which is surrounded by the upper warp layer and the lower warp layer, preferably has warp threads made from third yarns which consist of polyester. More preferably, the third yarns are multifilament yarns. These have a higher tensile strength than staple fibre yarns. They therefore give the fabric belt the ability to absorb forces in the inner warp layer by means of a material stretching of the third yarns. The same yarn counts are preferred for the third yarns as those for the first yarns and the second yarns.

BRIEF DESCRIPTION OF THE DRAWINGS

An exemplary embodiment of the invention is shown in the drawings and will be explained in more detail in the following description.

EXEMPLARY EMBODIMENT OF THE INVENTION

Figure 1:
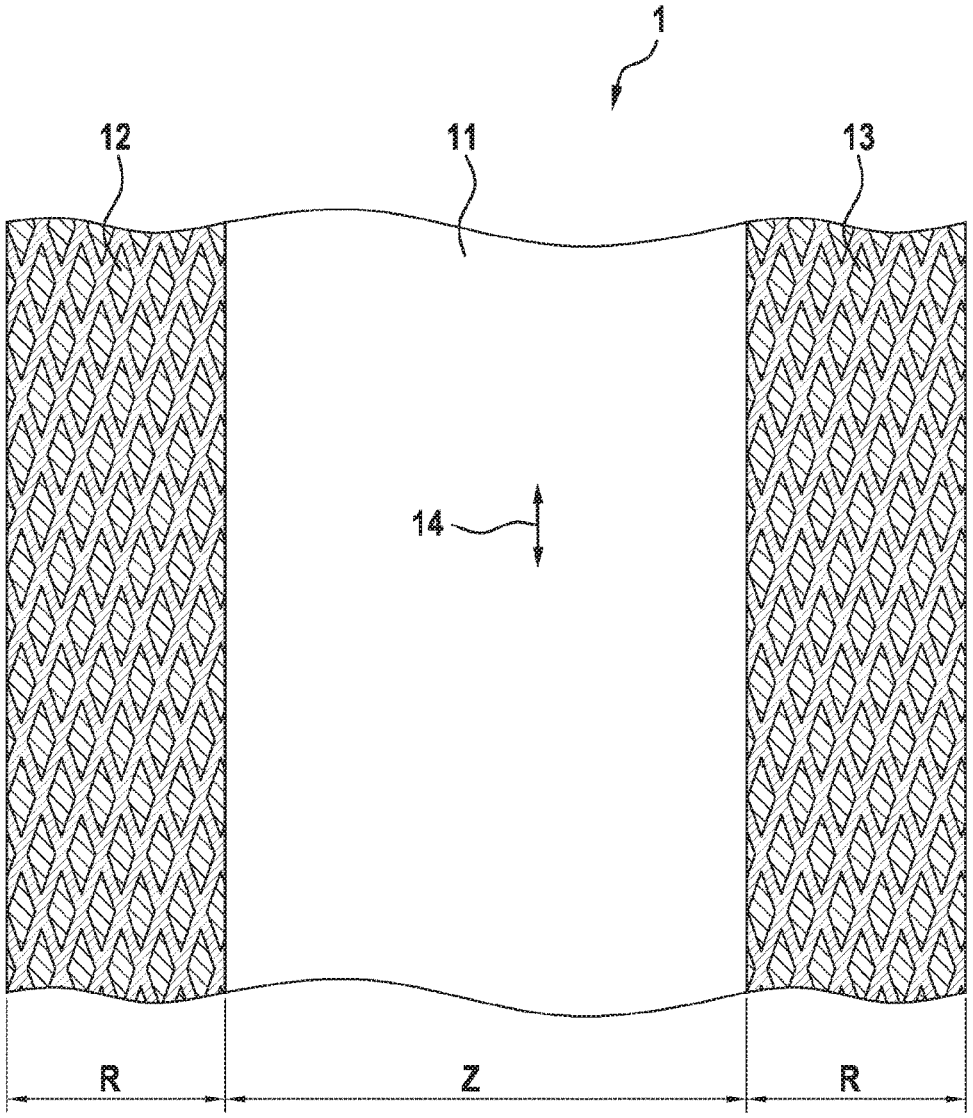
FIG. 1 shows a top view of a fabric belt according to one exemplary embodiment of the invention.

A section of a fabric belt 1, which can be used as an upper belt in a corrugated cardboard machine, is shown in FIG. 1. This has a central region 11 and two edge regions 12, 13. The edge regions 12, 13 run parallel to the longitudinal direction 14 of the fabric belt 1. In the present exemplary embodiment, the central region 11 has a width Z of 800 mm and the edge regions 12, 13 each have a width R of 400 mm.

The fabric belt 1 is drawn into the corrugated cardboard machine in the middle as a top belt and extends by a maximum of +/−0.5 cm in width. The corrugated cardboard runs underneath the belt, wherein the corrugated cardboard edges should lie within the edge regions 12, 13. The upper warp layer of the fabric belt 1 thereby points downwards and touches the corrugated cardboard.

Figure 2:
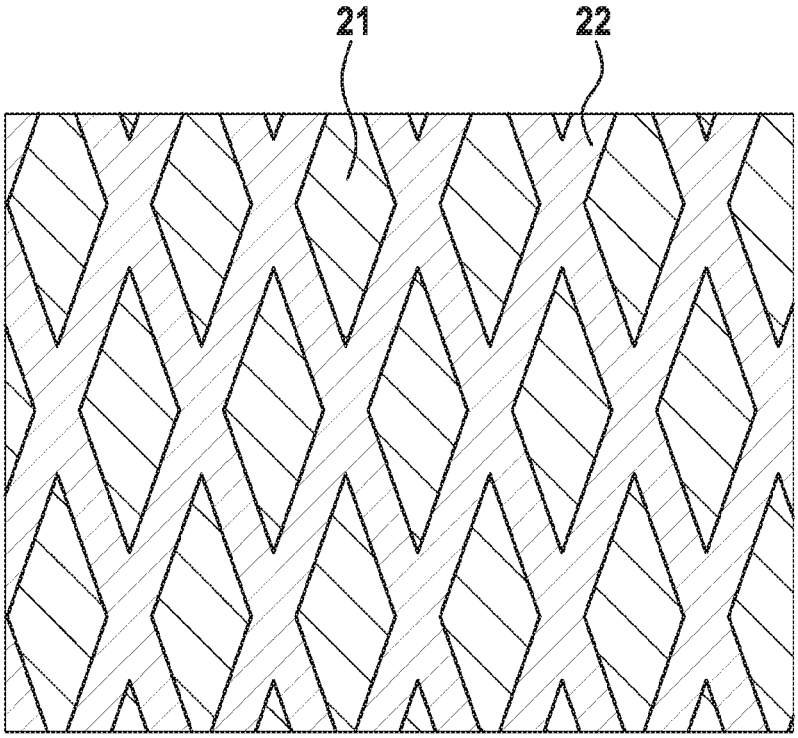
FIG. 2 shows a top view of the surface of an edge region of a fabric belt according to one exemplary embodiment of the invention.

The surface of the edge regions 12, 13 is shown in FIG. 2. This has first regions 21 made from first yarns and second regions 22 made from second yarns. The second regions 22 are connected to one another in the form of a grid pattern such that they separate the first regions 21 from one another. As a result, the first regions 21 form rhombic "islands" which do not touch one another. In the present case, the first yarns are Nm 20/6 staple fibre yarns with an effective yarn count of 3,000 dtex, which contain 50% b.w. meta-aramid, 35% b.w. polyamide 66 and 15% b.w. para-aramid. The second yarns are Nm 20/6 staple fibre yarns with a yarn count (effective yarn count) of 3,000 dtex, which contain 65% b.w. polyester and 35% b.w. viscose. The entire surface of the central region 11 consists only of the second yarns.

While the second yarns are raw white, the para-aramid portion of the first yarns gives them a yellow colour. The edge regions 12, 13 of the fabric belt 1 can therefore be visually distinguished from the fully white central region 11 by a yellow and white pattern.

Figure 3:
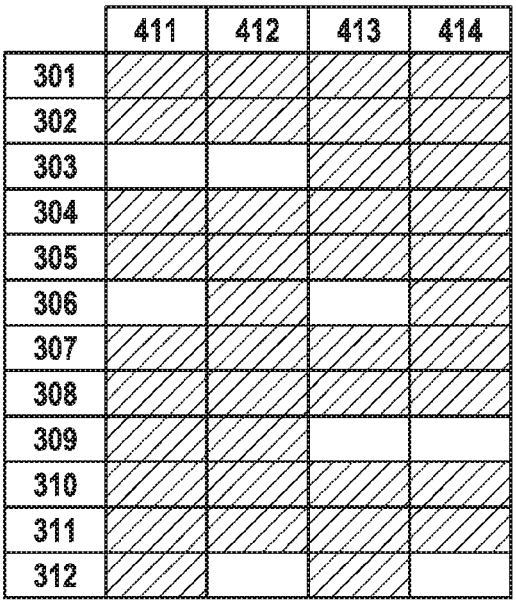
FIG. 3 shows the weave design of the edge region of the upper warp layer of a three-layered fabric belt according to one exemplary embodiment of the invention.

In the present exemplary embodiment, the fabric belt 1 is designed as a three-layered fabric. A section from the pattern repeat of its weave design is shown in FIG. 3. It has twelve rounds 301-312. The base warps are guided in 14 shafts 401-414, wherein only the upper base warp, which extends in the shafts 411-414 shown, is relevant for the formation of the first regions 21 and the second regions 22 on the surface of the edge regions 12, 13.

Figure 4A:
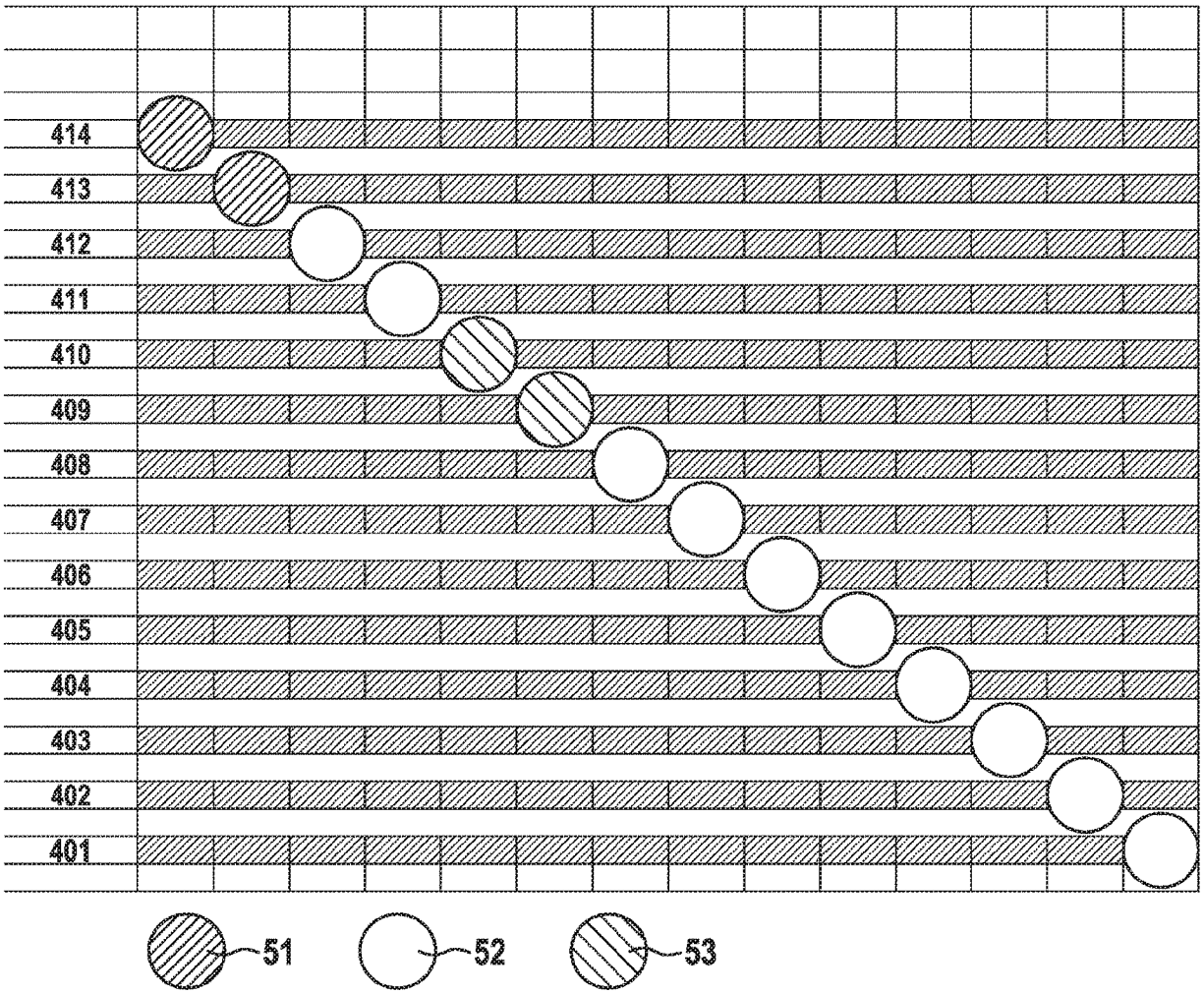
FIG. 4*a* schematically shows a stitch during the production of the edge region of a fabric belt according to one exemplary embodiment of the invention.
Figure 4B:
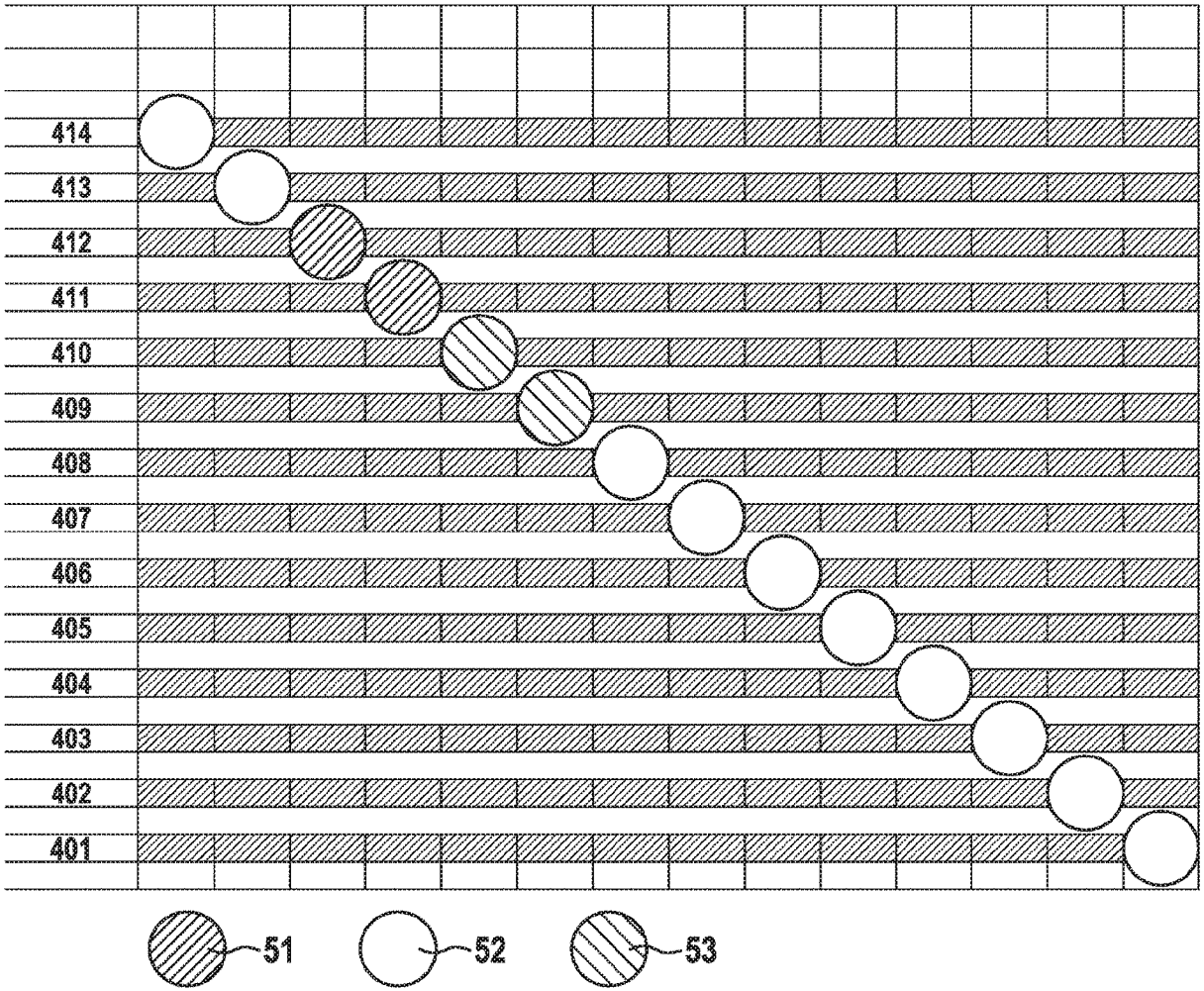
FIG. 4*b* shows another stitch during the production of the edge region of a fabric belt according to one exemplary embodiment of the invention.
Figure 4C:
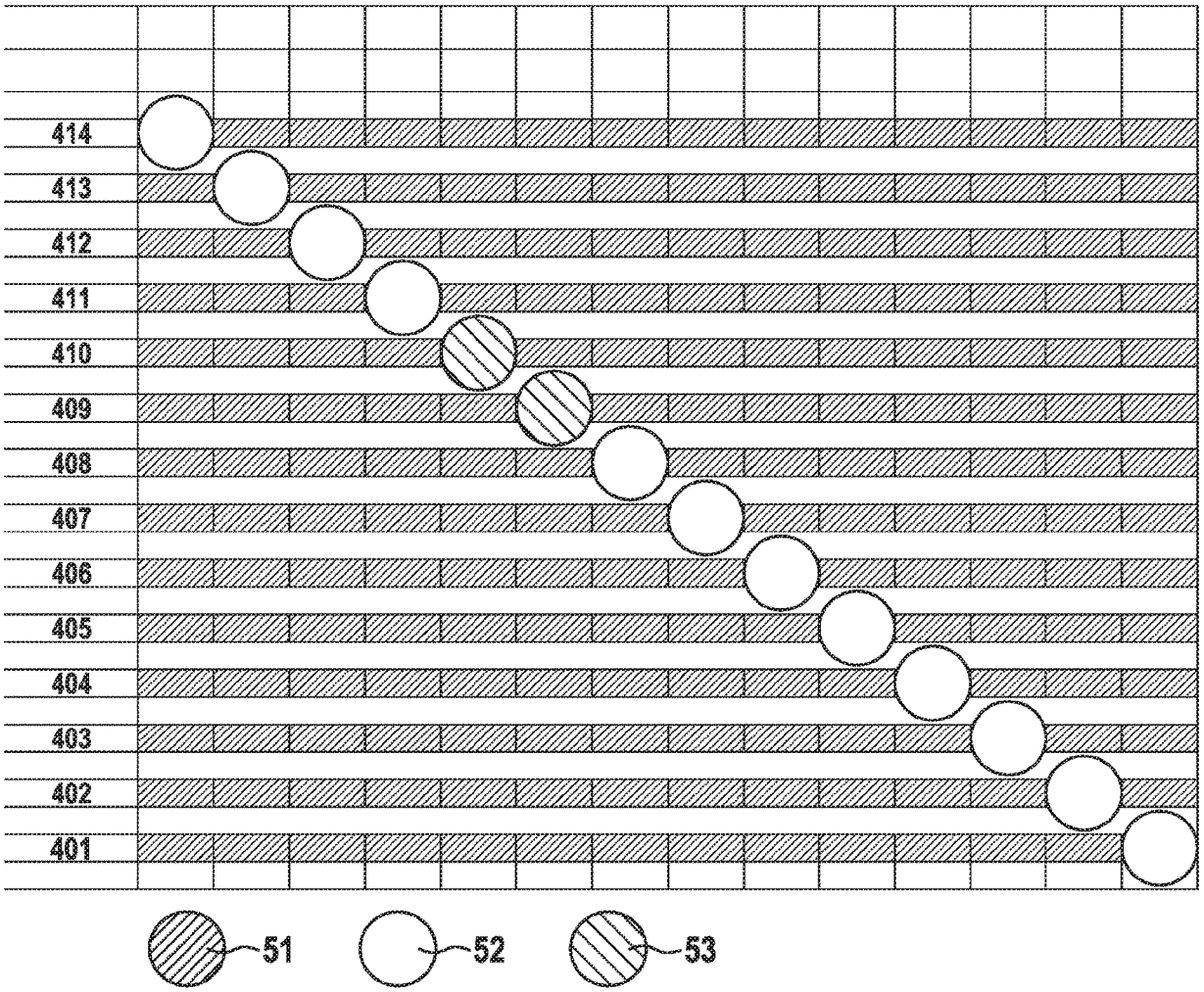
FIG. 4*c* shows yet another stitch during the production of a fabric belt according to one exemplary embodiment of the invention.

The indentation, which is used to achieve the pattern of the edge regions 12, 13 with the first regions 21 and the second regions 22, is shown for shafts 401-414 in FIGS. 4*a* to 4*c*. The first yarns 51 are only used in shafts 411-414. The second yarns 52 are used in shafts 401-408 and 411-414. In shafts 409 and 410, third yarns 53 are used. These are polyester multifilament yarns with a yarn count of 3,300 dtex. In shafts 401-404 and 409-410, two threads of the yarns n identified in FIGS. 4*a* to 4*c* are respectively guided through the heddles which are strung in the shafts. In shafts 405-408 and 411-414, three threads of the identified yarns are respectively guided through the heddles. The first stitch takes place according to FIG. 4*a* on the rear heddle rod of the weaving machine used. The second stitch takes place according to FIG. 4*b* on the front heddle rod. The third stitch takes place according to FIG. 4*c* on the rear heddle rod. The fourth stitch takes place according to FIG. 4*a* on the front heddle rod. The fifth stitch takes place according to FIG. 4*b* on the rear heddle rod. The sixth stitch takes place according to FIG. 4*c* on the front heddle rod. These six stitches are repeated until the desired width of the edge regions 12, 13 is achieved. In this way, a fabric is obtained in the edge regions 12, 13, whose top warp layer consists of one third of the first yarns 51 and two thirds of the second yarns 52 on its surface.

Figure 5:
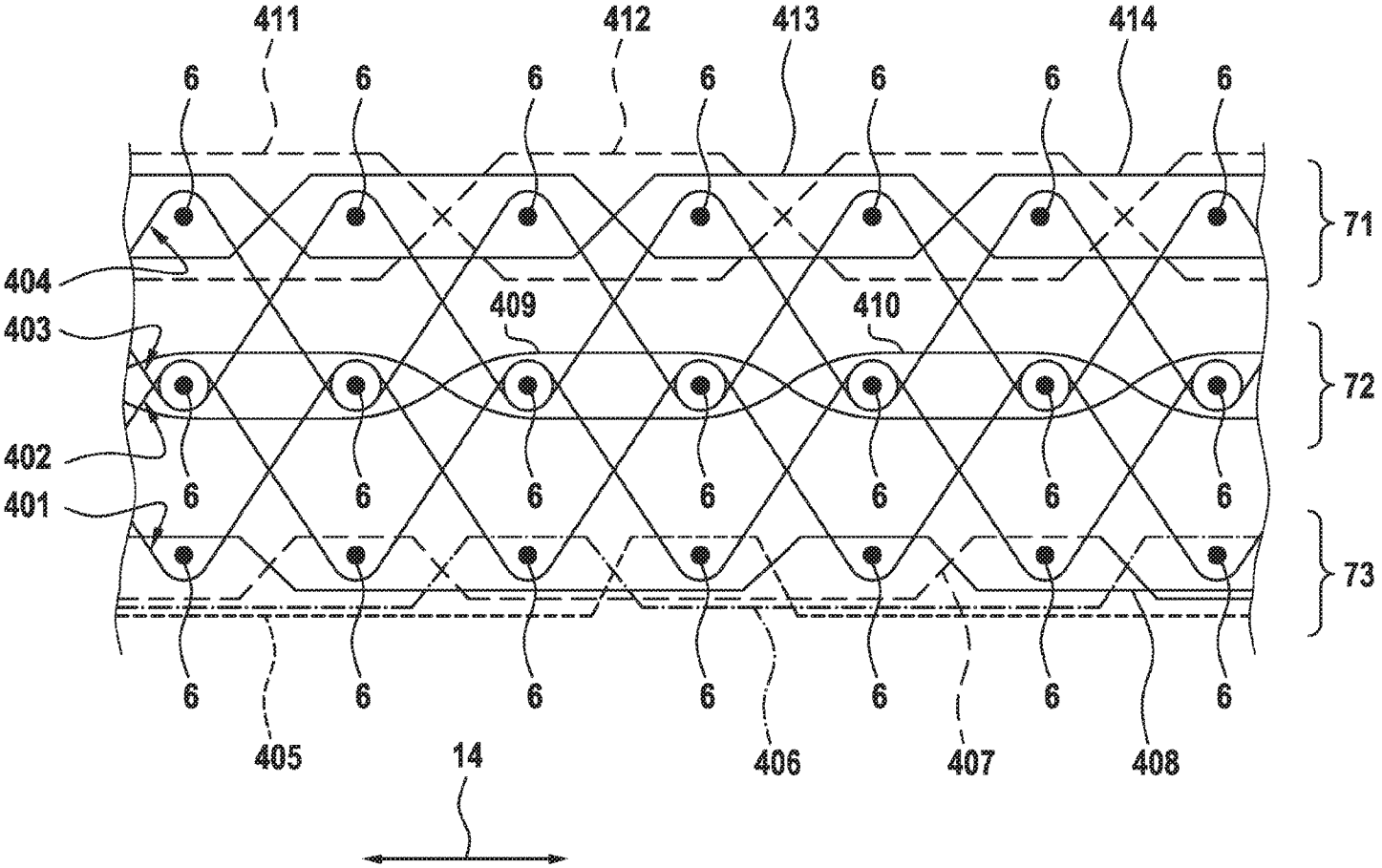
FIG. 5 shows a schematic longitudinal section of the edge region of a fabric belt according to one exemplary embodiment of the invention.

A longitudinal section of one of the edge regions 12, 13 is shown in FIG. 5. There, the warp threads and binding threads of the fabric are referred to using the same reference numerals which were used in FIGS. 4*a* to 4*c* for the respective shafts in which they are guided. In addition to the warp threads and binding threads, the weft threads 6 are also shown. It can be seen that the fabric has three warp layers 71, 72, 73. In the upper warp layer 71, which has the first regions 21 and the second regions 22 on its surface, four warp threads 411-414, which extend offset relative to one another, are provided, which extend both inwards towards the inner warp layer 72 and outwards towards the paper side, each over at least two weft threads 6. According to the depiction in FIGS. 4*a* to 4*c*, the warp threads 411-414 consist of one third of the first yarns 51 and two thirds of the second 52. The inner warp layer 72 has two warp threads 409, 410, which are offset relative to each other and which consist of third yarns 53 and each extend over two weft threads 6. The lower warp layer 73 consists of four warp threads 405-408 which extend offset relative to one another and which extend inwards, i.e. towards the inner warp layer 72, over only one weft thread 6 and outwards, over at least three weft threads 6. The warp threads 405-408 of the lower warp layer 73 consist of second yarns 52. The three warp layers 71, 72, 73 are interwoven with one another by means of binding threads 401-404. The binding threads are respectively divided into two thread groups, wherein the binding threads 403, 404 forming a thread group extend offset with respect to one another and bind the upper warp layer 71 to the inner warp layer 72. These binding threads 403, 404 are alternately guided around a weft thread 6 in the upper warp layer 71 and a weft thread 6 in the inner warp layer 72. In a corresponding manner, the thread group formed from the binding threads 401, 402 binds the lower warp layer 73 to the inner warp layer 72. All weft threads 6 consist of polyester staple fibre yarns. A "thread" is understood above to mean in each case a bundle of several threads, which respectively consists of two threads for the binding threads 401-404 and for the warp threads 409-410 of the inner warp layer 72 and respectively consists of three threads for the warp threads 405-408 of the lower warp layer 73 and warp threads 411-414 of the upper warp layer 71. Only the weft threads 6 respectively consist of only one thread.

During the operation of a corrugated cardboard machine, sections of the edge regions 12, 13 which are not covered by the corrugated cardboard web are temporarily exposed to the heating plates of the corrugated cardboard machine. Thermal and mechanical damage to the edge regions 12, 13 is thereby prevented by the first regions 21 which consist of the first yarns 51. The sections of the edge regions 12, 13 which cover the corrugated cardboard absorb water and steam from the corrugated cardboard web as part of moisture management. Here, water can be absorbed between the staple fibres by the first yarns 51 and by the second yarns 52. In addition, the viscose portion of the second yarns 52 can absorb up to 80% of its own weight of moisture. The edge regions 12, 13 of the fabric belt 1 thus fulfil a hybrid function of thermal and mechanical protection and moisture management.

The invention claimed is:

1. A fabric belt (1) for the production of a corrugated cardboard web in a corrugated cardboard machine having several warp layers (71, 72, 73), characterised in that, in at least one edge region (12, 13) of the fabric belt (1), a surface of its upper warp layer (71) has at least first regions (21) which consist of first yarns (51), and second regions (22) which consist of second yarns (52), wherein the first yarns (51) contain 30% b.w. to 100% b.w. aromatic polyamides, 0% b.w. to 70% b.w. aliphatic and/or alicyclic polyamides and 0% b.w. to 5% b.w. other materials, wherein the total of the polyamides and other materials gives 1.00% b.w., and the second yarns (52) contain 50% b.w. to 85% b.w. polyester and/or aliphatic polyamides and/or alicyclic polyamides, 15% b.w. to 50% b.w. cellulose and 0% b.w. to 5% b.w. other materials, wherein the total of the polyesters, polyamides, cellulose and other materials gives 100% b.w.

2. The fabric belt (1) according to claim 1, characterised in that the first regions (21) cover ⅙ to ⅚ of the surface of the at least one edge region (12, 13) and the second or more regions (22) cover the rest of the surface.

3. The fabric belt (1) according to claim 1, characterised in that the width (R) of each edge region (12, 13) ranges from 400 mm to 650 mm.

4. The fabric belt (1) according to claim 1, characterised in that it has two edge regions (12, 13), between which a central region (11) is located which only has second yarns (52) on the surface of its upper warp layer.

5. The fabric belt (1) according to claim 4, characterised in that the central region (11) has a width (Z) in the range from 800 mm to 2,100 m.

6. The fabric belt (1) according to claim 1, characterised in that the first yarns (51) and the second yarns (52) are staple fibre yarns.

7. The fabric belt (1) according to claim 1, characterised in that the first yarns (51) and the second yarns (52) respectively have a yarn count in the range from 1,000 dtex to 5,000 dtex.

8. The fabric belt (1) according to claim 1, characterised in that the first yarns (51) contain at least 30% b.w. meta-aramid.

9. The fabric belt (1) according to claim 1, characterised in that the first yarns (51) contain at least 10% b.w. para-aramid.

10. The fabric belt (1) according to claim 1, characterised in that the aliphatic and/or alicyclic polyamides of the first yarns (51) are selected from PA6 and/or PA66.

11. The fabric belt (1) according to claim 1, characterised in that the warp threads (411, 412, 413, 414) of the upper warp layer (71) consist of the first yarns (51) and the second yarns (52).

12. The fabric belt (1) according to claim 1, characterised in that it has an upper warp layer (71), an inner warp layer (72), a lower warp layer (73), binding threads (401, 402, 403, 404) as well as two to four layers of weft threads (6).

13. The fabric belt (1) according to claim 1, characterised in that it has binding threads (401, 402, 403, 404) which consist of the second yarns (52).

14. The fabric belt (1) according to claim 1, characterised in that an inner warp layer (72) has warp threads (409, 410) made from third yarns (53) which consist of polyester.

15. The fabric belt (1) according to claim 14, characterised in that the third yarns (53) are multifilament yarns.

* * * * *